United States Patent [19]

Kim et al.

[11] 4,441,237

[45] Apr. 10, 1984

[54] INHOMOGENOUS ANISOTROPIC KINETIC ENERGY PENETRATORS

[75] Inventors: Chulho Kim, Alexandria; Raymond J. Weimer, Burke, both of Va.

[73] Assignee: The United States of America as represented by the Secretary of the Navy, Washington, D.C.

[21] Appl. No.: 132,462

[22] Filed: Apr. 1, 1980

[51] Int. Cl.[3] ..... B21K 21/06

[52] U.S. Cl. ..... 29/1.2; 29/419 R; 148/11.5 Q; 264/290.2; 264/290.5

[58] Field of Search ..... 29/1.2, DIG. 11, DIG. 13, 29/DIG. 15, DIG. 24, DIG. 42, 419 R; 72/342, 371; 148/11.59; 264/290.5, 290.2

[56] References Cited

U.S. PATENT DOCUMENTS 2,356,966 8/1944 Bardel ..... 29/1.2

FOREIGN PATENT DOCUMENTS 9382 of 1886 United Kingdom ..... 29/1.11

*Primary Examiner*—Donald P. Walsh

*Attorney, Agent, or Firm*—Robert F. Beers; William T. Ellis; Philip Schneider

[57] ABSTRACT

This invention is directed to a method of fabricating kinetic-energy projectiles from composite materials in such a manner that the type and degree of local inhomogeneity and anisotropy is controlled for tailoring the mechanical and physical properties of the projectile for different applications. A continuous rod of composite material is fed into a machine having a stationary holder or gripper and a rotatable holder or gripper which grips the rod. An induction heater heats a particular zone of the rod between the holders. Once the rod zone has been heated, the rotatable holder is rotated through a particular predetermined angular twist about the longitudinal axis, thereby applying a torque on the rod which causes the rod to deform in the heated zone. Depending upon the heated zone length, projectile noses in near-final shapes ranging from rather blunt hemispheres to sharp ogives can be formed. Subsequent to twisting, the rod is released and advanced a sufficient length to form two projectile lengths between the shaped ends. The rod is cut in half between the deformed ends to form two projectiles of desired lengths.

4 Claims, 9 Drawing Figures

INHOMOGENOUS ANISOTROPIC KINETIC ENERGY PENETRATORS

BACKGROUND OF THE INVENTION

This invention relates to kinetic-energy projectiles and more particularly to a method of forming kinetic-energy projectiles substantially in their finished form directly from a rod stock.

Heretofore, projectiles have been machined by grinding or point-cutting rods to give an end of a desired shape. This process wastes a considerable amount of material.

Another method is set forth in U.S. Pat. No. 2,356,966 which makes use of upper and lower dies. The upper die is hammered against the lower die and a heated rod in the die to cut the rod in two. The cut ends are pointed and the pointed end of the cut rod is placed in a swaging machine. The cut rod is rotated while in the swaging machine and the end is shaped to the desired shape.

SUMMARY OF THE INVENTION

The method of this invention provides simplification of the formation of differently shaped projectile nose ends by heating different-length sections of a rod from which the projectiles are made. The projectiles are formed with minimum material wastes and may make use of a continuous rod from which the projectiles are made. The projectiles made by the present process are improved by an increased volume percentage reinforcement in the nose end, which permits greater penetration of the projectile into a target.

DETAILED DESCRIPTION

Figures 1, 2, 3:
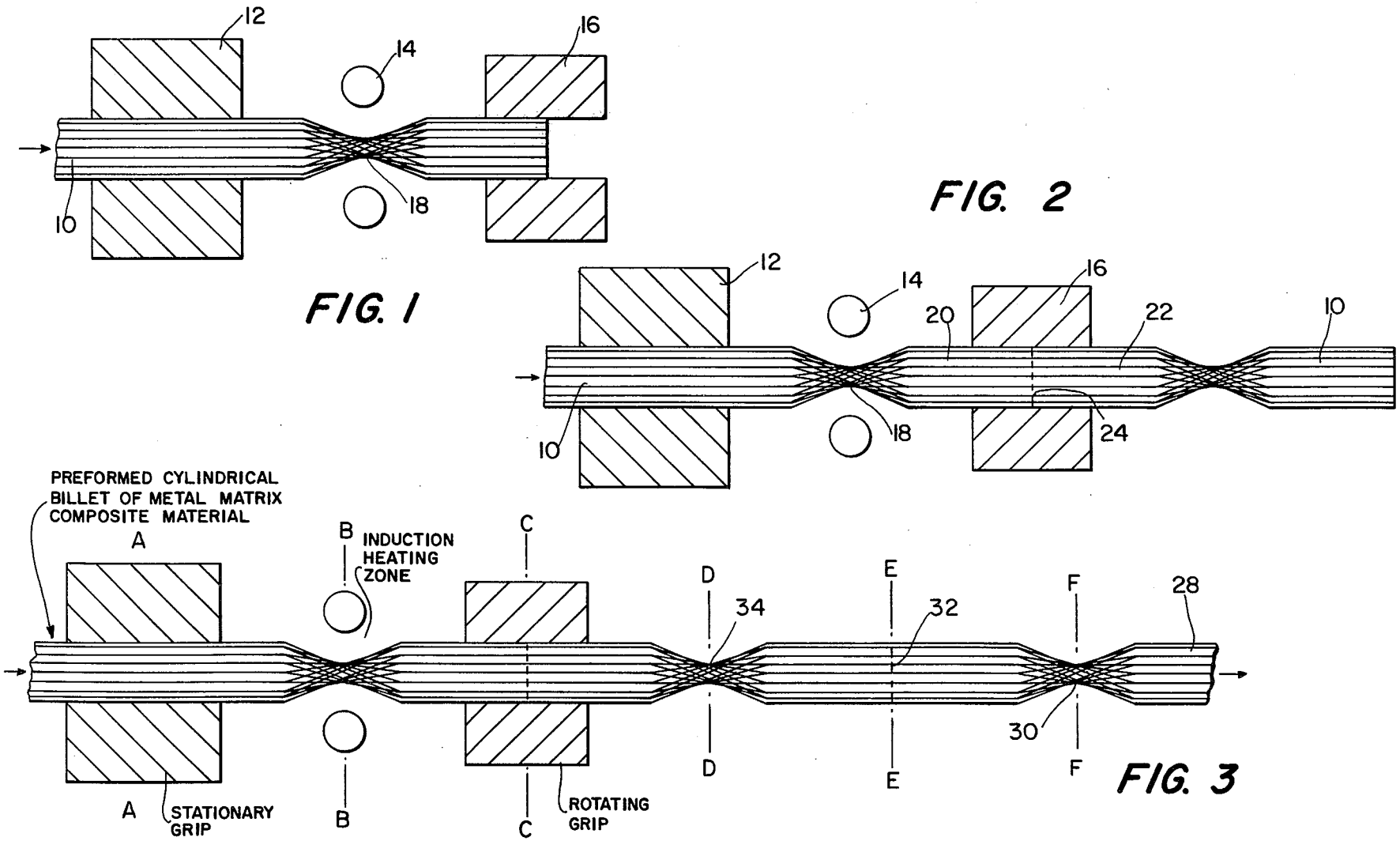
FIG. 1 illustrates in block diagram a device for carrying out the invention.
FIG. 2 illustrates the projectile advanced subsequent to formation by the device.
FIG. 3 illustrates the rod further advanced with additional formations.

FIG. 1 represents in block diagram, a device for carrying out the method of this invention. A preformed, cylindrical billet or rod of metal matrix composite material 10 from which projectiles may be formed is fed through a stationary gripper 12. The rod is fed through an induction heater 14 to a rotatable gripper 16. The rod is heated by the induction heater to soften the rod material in the area 18 of the induction heater. Once the rod has become soft in the area of the induction heater, the rotatable gripper is rotated through a desired number of degrees, about 135 degrees. Torque applied to the rod by the rotatable gripper causes the rod to deform along the softened region of the rod in the area 18. The rod is deformed such that the deformed section has the shape of similar conical sections joined along the center and perpendicular to the axis of the deformed section.

FIG. 2 illustrates the rod advanced sufficiently to deform the rod in a second section subsequent to advancing the rod sufficiently to form two lengths 20 and 22 of a desired-length projectile depicted by a dotted line 24 between the centers of the first and second deformed sections.

FIG. 3 illustrates the rod advanced a second time sufficiently to deform the rod such that two more projectiles will be formed by the section of the rod between the two centers of the two deformed sections. The rod is advanced, softened in the area of the induction heater zone, rotated through the desired degrees and advanced for the next projectile lengths. The cycle is repeated in a continuous process to form desired-length projectiles along the length of the entire rod. Two projectiles are formed by the length of the rod between the mid-points. Once the rod has been cycled a few times and advanced well beyond the rotatable gripper, a rod-cutting machine may be used to cut the projectiles in their desired length. Using FIG. 3 for illustration, the end-most rod 28 will be cut at the center of the deformed section at 30, then the rod will be cut at the center 32 between the centers of the deformed sections at 30 and 34. By repeating the cycle of deforming, advancing the rod, heating, and cutting the rod as set forth above, projectiles may be continuously formed. It is noted that two projectiles are formed between each of the heated areas. The heated area forms the nose of two projectiles. With the rod cut midway between the deformed region two projectiles are formed.

Figure 8:
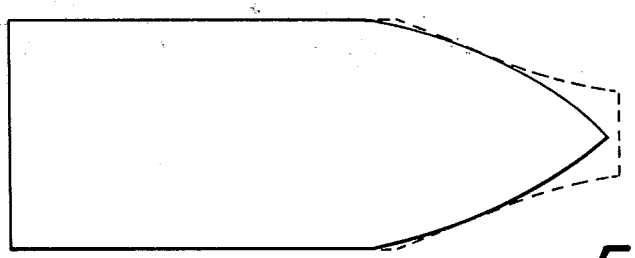
FIG. 8 illustrates a projectile formed from the formed element of FIG. 4.
Figure 9:
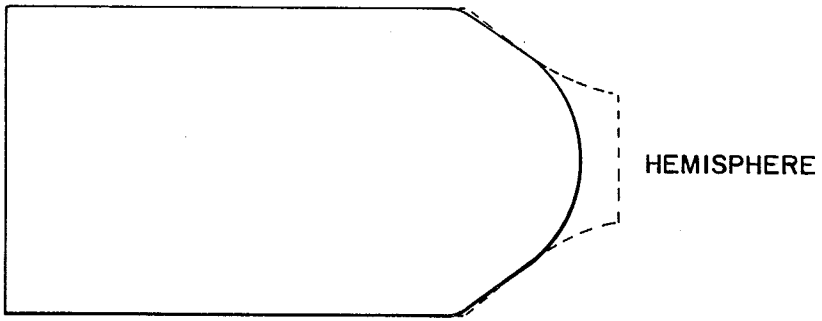
FIG. 9 illustrates a projectile formed from the formed element of FIG. 5.

Subsequent to being cut from the rod into the separate pieces, the ends of the projectiles are shaped by removing the excess material as shown in FIGS. 8 and 9. The dotted lines indicate the material that is removed in the final shaping.

Figure 4:
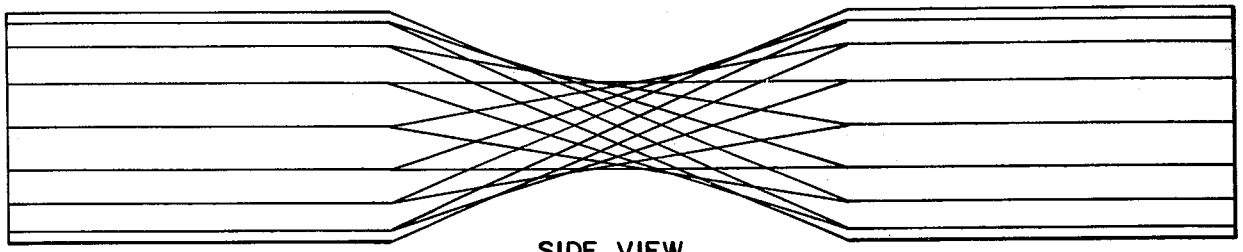
FIGS. 4 and 5 illustrate side views of projectiles formed with different-length noses.
Figure 5:
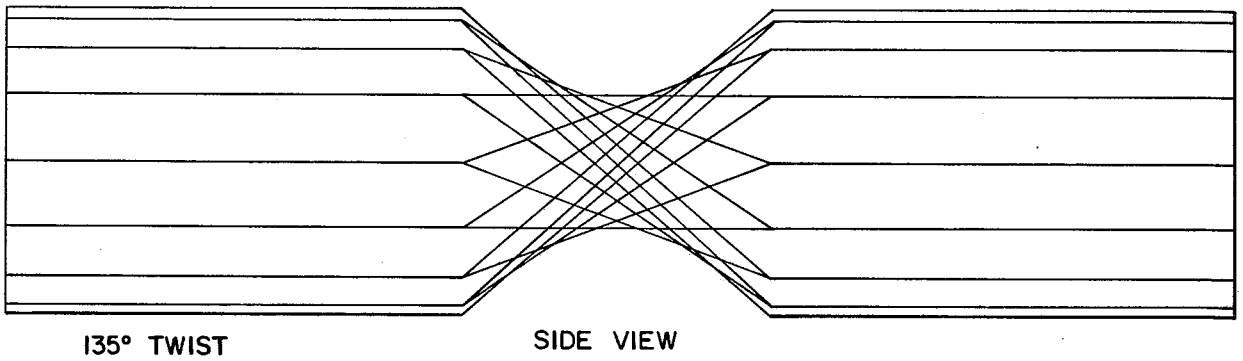

FIGS. 4 and 5 are side views which show deformed nose sections of a different lengths between the non-deformed bodies of two projectiles. By changing the width of the induction heating zone the length of the deformed section may be changed. By changing the length of the deformed section, the reinforcement contour in the nose of the projectile may be changed.

Figure 7:
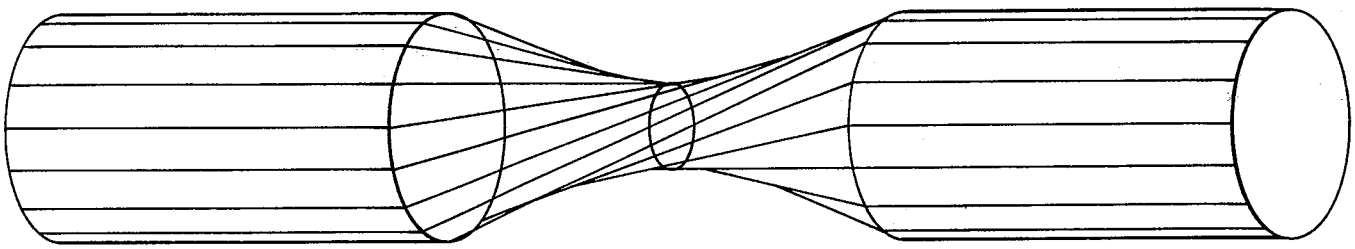
FIGS. 6 and 7 illustrate oblique views of the projectiles of FIGS. 4 and 5.
Figure 6:
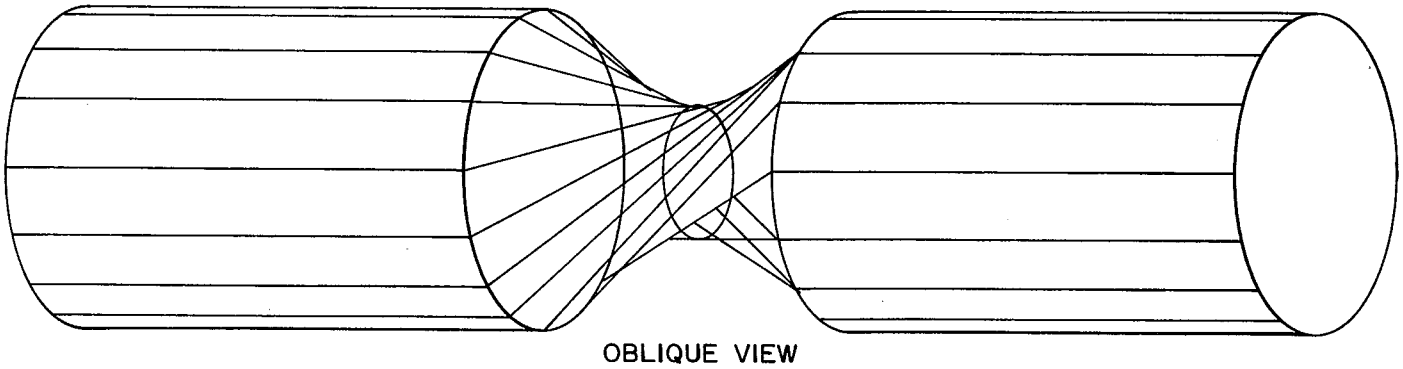

FIGS. 6 and 7 are oblique views of the deformed rods shown in FIGS. 4 and 5. These views more clearly illustrate the particular shapes of the cylindrical body material and of the deformed nose sections.

FIG. 8 illustrates a projectile formed from the deformed section shown in FIG. 4.

FIG. 9 illustrates a projectile formed from the deformed section shown in FIG. 5.

The projectiles shown in FIGS. 8 and 9 show in dotted line the projectile as cut from the rod with the finished projectile shown in solid form. It is apparent from viewing the drawings that the longer the heated section along the rod, the more pointed the projectile will be in the finished product. In the views shown by FIGS. 4–9, each of the rotatable grips holding the rod have been rotated through a twist of 135 degrees. The projectile formed by the longer heated length is formed with a nose of ogive shape, whereas the nose of the projectile formed from the shorter heated length takes the form of a hemispherical end.

Rods of material from which the projectiles are made are fabricated from a composite material, such as steel with tungsten fibers embedded within the steel matrix to provide strengthening and to promote dynamic compression failure modes that significantly improve penetration of the projectile into the target. The composite material may be fabricated in such a way that the type and degree of local inhomogeneity and anisotropy may be controlled to tailor the mechanical and physical properties of the projectile to suit the particular needs. By twisting the rod in the softened region, the fibers cross the nose of the formed projectile and thereby form a nose which is harder than the main body of the projectile due to increased volume percentage reinforcement in the nose.

Obviously many modifications and variations of the present invention are possible in light of the above teachings. It is therefore to be understood that within the scope of the appended claims the invention may be practiced otherwise than as specifically described.

We claim:

1. A method of forming projectiles which comprises:

feeding a rod of fiber-reinforced composite material through a stationary gripper, through a heater region and a rotatable gripper such that the distance between the center of the heater region and the center of the rotatable gripper is equal to the length of one projectile to be formed; and the distance between the center of the heater region and the center of the stationary gripper is equal to the length of a second projectile to be formed;

activating said stationary gripper to hold said rod in place against rotation and activating the rotatable gripper to grip said rod therein for rotation therewith;

heating said rod along a desired length with the heat centered in the heater region and concentrated on said rod section until said rod is soft;

rotating said rotatable gripper through a desired number of degrees of rotation thereby rotating said rod along with said rotatable gripper and thereby deforming said rod in the heated region;

inactivating said heater to stop heating said rod, releasing the rod from the grip of said stationary and rotatable grippers, feeding the rod relative to said grippers and said heater zone for a distance sufficient to form two projectiles, and repeating the cycle of heating, gripping, and rotating said rod in order to deform said rod in another desired length of said rod.

2. A method as claimed in claim 1 wherein:

said rod is cut into projectile lengths by cutting said rod across the center of said deformed sections and at the mid-point between adjacent deformed sections with each deformed section forming the noses for two projectiles; and machining said formed noses to form a finished nose shape for said projectiles.

3. A method as claimed in claim 2 wherein:

said heated section of said rod is of a short length for forming projectiles with noses similar to a hemisphere.

4. A method as claimed in claim 2 wherein:

said heated section of said rod is of a long length for forming projectiles with ogive noses.

* * * * *